US005544701A

United States Patent [19]

Elder

[11] Patent Number: 5,544,701

[45] Date of Patent: Aug. 13, 1996

[54] CANISTER WARMING APPARATUS

[76] Inventor: Roy W. Elder, 12505 Rock Chapel Ct., Herndon, Va. 22070

[21] Appl. No.: 277,505

[22] Filed: Jul. 19, 1994

[51] Int. Cl.[6] ..... F28F 7/00

[52] U.S. Cl. ..... 165/80.5; 126/261; 4/605

[58] Field of Search ..... 165/80.5, 169; 4/605; 126/261

[56] References Cited

U.S. PATENT DOCUMENTS

| | | | |
|---|---|---|---|
| 2,137,676 | 11/1938 | Martin | 165/80.5 X |
| 4,327,961 | 5/1982 | Kladitis | 350/66 |
| 4,557,003 | 12/1985 | Jones | 4/605 |
| 4,782,670 | 11/1988 | Long et al. | 62/457 |

FOREIGN PATENT DOCUMENTS

| | | | |
|---|---|---|---|
| 1136332 | 5/1957 | France | 165/80.5 |

*Primary Examiner*—Allen J. Flanigan

*Attorney, Agent, or Firm*—Rodger H. Flagg

[57] ABSTRACT

A warming apparatus uses shower or bath water to warm a canister, such as a shaving cream canister, to a comfortable temperature while washing or showering. The canister is inserted into a warming chamber which is partially surrounded by a water jacket formed between an inner wall, an outer wall, an upper end plate and a lower end plate. An inlet fitting extends from the water jacket to a water supply line. An outlet fitting extends from the water jacket to a shower head. As shower water flows through the water jacket heat is transferred from the water to the inner wall, and from the inner wall to the warming chamber. The inner wall may be ribbed or finned to increase the surface area of the inner wall within the water jacket. The unit may alternatively be connected into the water line by flexible hoses running from the warming apparatus to a diverter fastened between the pipe and shower head. The warming chamber may include at least one drain hole extending from the warming chamber. A resilient collar preferably extends about an aperture in the upper plate to closely receive the canister. A mounting bracket may also be provided.

22 Claims, 2 Drawing Sheets

CANISTER WARMING APPARATUS

BACKGROUND OF THE INVENTION

1. Field of the Invention

The present invention relates to canister warming apparatus for bathroom use.

2. Description of the Related Art

Shaving is easiest and most comfortable when the body area to be shaved has been warm and wet for some time, because this softens the hairs and makes them easier to cut. Barbers traditionally place a hot, wet towel over a man's face prior to shaving it, and use warm lather when shaving.

Today most people are home shavers. Most shavers, do not take time to heat towels for shaving. Most shavers use shaving cream or gel from a can. For both comfort and shaving efficiency, the shaving cream should be warm. Warming a can of shaving cream requires more work and effort than most shavers expend.

Shaving is virtually always done in the bathroom. Many people shave during or after a bath or shower, when the hairs are soft. Shaved hairs can easily be washed down the drain during a shower, and shaving cream can easily be rinsed away.

If shaving is done over a sink, a can of shaving cream might be heated in a stoppered sink full of hot water, but this ties up the sink, covers the can with scum, and wastes heat. (Only a small portion of the energy in the hot water goes into the shaving cream. The rest heats the bathroom, or fogs up the mirror.)

If shaving is done during a bath, the shaving cream can be left bobbing in the bath water. This is an energy-efficient way to heat the shaving cream to a comfortable temperature, but having an extra object in the tub can be irksome and difficult to find when needed.

Showering is more common than bathing and uses less water and energy. For those who shower, there is no convenient way to immerse a can of shaving cream in water. A cup, mug, or small bucket could be used, but this would need to be periodically drained and held in the shower stream to replace the cooled water with hot water.

A bottle warmer, hot plate, or the like could be placed in bathroom for heating a can of shaving cream. However, any device used for heating a shaving cream can, when used in or within the reach of a shower, should not use electric current. Use of 120-volt electricity is too dangerous for people who are standing or immersed in water. A plug-in device would have to be located out of reach of the tub or shower stall, the very place where many people like to shave. Moreover, heating a shaving cream can with electricity is doubly dangerous since overheating may cause the shaving cream can to explode. Batteries are generally not satisfactory for high-wattage applications like heating.

Shelf or counter space for a warming device is often scarce in a bathroom. Thus, even if shaving is done after showering, when outside the tub or stall, electric warming is still impractical.

Several prior-art inventions warm containers with water, which does not pose a shock hazard.

U.S. Pat. No. 4,597,435, issued to Benjamin Fosco, Jr., shows a bottle warmer or cooler for bringing flexible bag liner-type baby bottles to a desired temperature. The device includes a handled cylindrical container having a tube which runs vertically along the inner wall from the lip to a point about an inch from the bottom. The tube is open on both ends, and water from a faucet is poured into the upper end. The water passing through the tube exits upwardly through openings in a baffle plate to flow upward past a baby bottle sitting in the container. The bottle is centrally located by four brackets which project from the interior of the container. The water, having moved up past the length of the bottle, runs over the lip of the container and down the container sides.

The Fosco, Jr. invention transfers heat or cold by wetting the outside of the plastic bag of the baby bottle. To achieve a desired temperature, the water from the faucet must be run until the temperature reaches equilibrium. The flow of hot and cold water must be adjusted to reach the desired temperature. For rapid temperature change, the water temperature must be set higher or lower than the desired temperature and the bottle immersion timed carefully. If timing is wrong or the flow rates change due to a faucet being opened elsewhere, the temperature can become dangerously high.

The brackets 40 are spaced to snugly hold the standard baby bottles having a typical diameter of about two and ¼ inches. Thus, the Fosco, Jr. invention would be unable to accept many large cans of shaving cream, which typically have a standard diameter of about two and ⅝ inches.

The Fosco, Jr. patent does not provide a means for attaching or mounting his device to a wall or shower stall. His device includes a handle 22 for lifting, and is intended for use in a sink (column 3, line 43) to catch the overflow.

Fosco, Jr. refers to U.S. Pat. No. 4,163,471, issued to Frederic Leder. Leder's invention also warms baby bottles with flowing faucet water, but the direction of flow is opposite to the Fosco, Jr. device. There is no tube. Water runs over the top of the bottle and down the sides as it stands in a container. At the bottom of the container the water escapes the container through drain openings 22. Wall spacers project inwardly to hold the bottle. Leder adjusts the drain area to limit the water flow rate without overflowing. However, Leder's device is wasteful of water and the thermal efficiency remains low. Leder's invention is not sized to accept larger cans of shaving cream.

F. C. Peterson teaches a device somewhat similar to Leder's in U.S. Pat. No. 3,402,763. Peterson connects a flexible hose from a faucet directly into a baby bottle. The water passes into the space between a rigid outer bottle and the flexible inner liner containing milk or formula, then drains out through holes in the outer bottle. As in the Leder device, the flow is from top to bottom.

U.S. Pat. No. 4,410,034, issued to Bernhardt et al., shows a water tank 11 with an opening specially shaped to hold a bottle so that it is immersed in tank water that is at a particular temperature. The bottle must have a particular shape to fit into the tank. The bottle must be deformable (see column 3, line 55) to assume different shapes. There is no flow of heating fluid in the Bernhardt et al. invention, nor any means of increasing convection between the heating fluid and the container.

U.S. Pat. No. 3,362,466, issued to J. D. Columbo, shows an apparatus for heating steel drums with steam. Steam nozzles are disposed under a grate on which a drum rests, and a cover is put over the drum. Steam from the nozzles condenses and runs down through the grate.

Mack Frank, Jr. depicts a shower bath caddie in U.S. Pat. No. 3,869,183. The caddie attaches to the wall of the shower and swings out for shaving. The caddie includes a mirror and spaces for razors, shaving cream, etc.

Prior-art inventions do not permit carefree, inexpensive, and efficient warming of a shaving cream container in a shower. Shower water is an ideal medium for warming shaving cream. Shower water is always at a temperature that is comfortable and safe for heating a can of shaving cream. Shower water poses no threat of electric shock, overheating, burning, or explosion. The shower water used for showering is also used for warming the shaving cream canister, without wasting water.

SUMMARY OF THE INVENTION

Accordingly, the present invention uses shower water or bath water for heating a canister (can) of shaving cream or gel, to bring the shaving cream to a comfortable temperature of about 85 degrees F. to about 95 degrees F. The shower water is made to flow through a water jacket disposed around a warming chamber into which the canister is placed prior to bathing. Heat flows from the heated water circulating through the water jacket into the walls of the chamber. The heat is transferred from the inner chamber wall into the space surrounding the shaving cream canister. The shaving cream canister and its contents are warmed by the shower water, as the shower water passes through the water jacket and the shower head, onto the user.

The above mentioned and other features and objects of the invention, and the manner of attaining them will be best understood by reference to the following description of an embodiment of the invention, when considered in conjunction with the accompanying drawings:

DETAILED DESCRIPTION OF THE PREFERRED EMBODIMENTS

The following definitions are provided to disclose and illustrate applicant's preferred embodiment, and to more precisely claim applicant's invention:

"Shaving cream" includes creams, foams, gels, pastes, lotions or other liquids or semi-liquids used for shaving;

"water supply line" means a water conduit or conduits (such as pipes, tubes, hoses, etc.) conducting water from a hot-cold mixing valve, confluence of hot and cold water pipes, or water heater, to a shower head, faucet, sink or other place where water is discharged into an open space or container such as a tub, basin or shower stall;

"water jacket" means a fluid tight chamber, having an interior space of arbitrary shape, for holding or conducting pressurized fluid.

Figure 1:
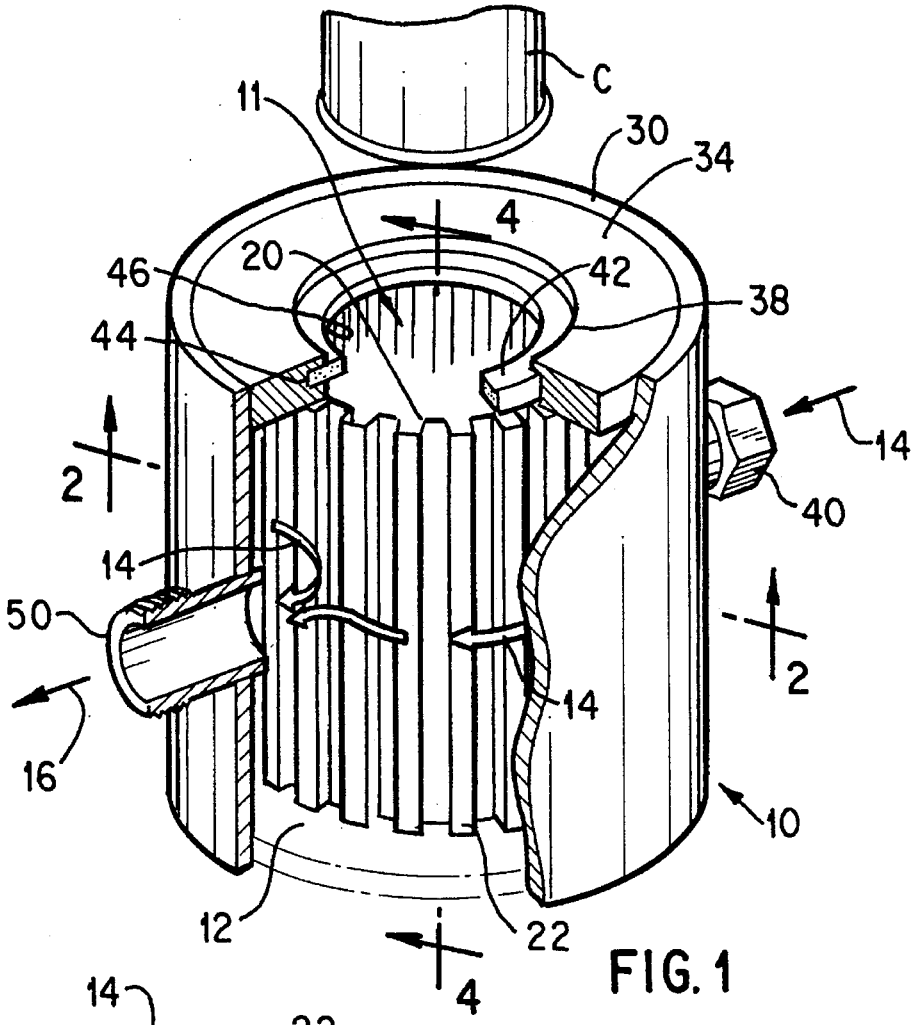
FIG. 1 is a perspective, partially cut-away view of the shaving cream warming apparatus.

FIG. 1 comprises a warming apparatus 10 used to warm shaving cream to about 85 to 95 degrees F. The bottom end of a canister of shaving cream "C" is also shown in exploded view in FIG. 1, poised for insertion into the warming chamber 11 of the warming apparatus 10.

The warming apparatus 10 includes a water jacket 12 through which water "W" flows from a suitable water supply line 8. The water "W" is contained in the space between a generally cylindrical inner wall 20 and an outer wall 30 spaced from the inner wall 20. The inner wall 20 and outer wall 30 are preferably secured together with a lower end plate 32 and an upper end plate 34, forming the water jacket 12 therebetween.

Figure 2:
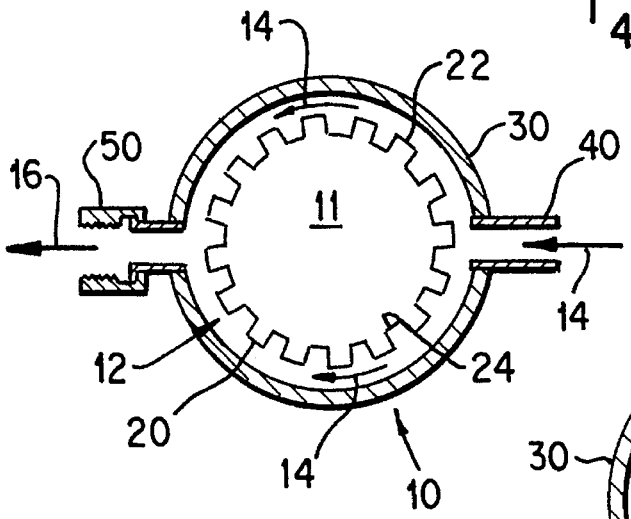
FIG. 2 is a cross sectional view of the invention taken along lines 2—2 in FIG. 1.

When the warming apparatus 10 is connected into a remote water line 8, water "W" is admitted into the water jacket 12 through an inlet fitting 40 and after circulating through the water jacket 12 as shown by arrow 14, the water "W" exits through the outlet fitting 50 as shown by arrow 16. The inlet and outlet fittings 40, 50 preferably extend through the outer wall 30 of the warming apparatus 10. As shown in FIG. 1 and 2, the inlet and outlet fittings 40, 50 may be positioned on opposing sides of the outer wall 30, approximately 180 degrees apart. The water "W" entering the water jacket 12 is slowed down as it enters the greater volume of the water jacket 12, providing improved transfer of heat between the water "W" and the inner wall 20 of the water jacket 12.

Figure 3:
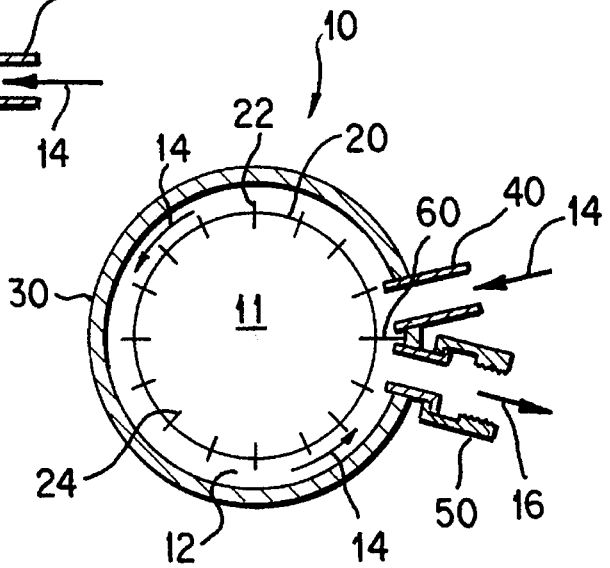
FIG. 3 is a cross sectional view similar to that of FIG. 2, showing an alternative configuration of the water flow path of the invention.

Alternately, as shown in FIG. 3, the inlet and outlet fittings 40, 50 may be located in close proximity to each other, providing a suitable baffle 60 is placed in the water jacket 12 between the inner wall 20 and the outer wall 30 and the upper and lower end plates 32, 34. The baffle 60 is positioned to force the circulating water "W" to travel from the inlet fitting 40, substantially around the water jacket 12, to the outlet fitting 50. This configuration provides a greater travel distance between the inlet fitting 40 and the outlet fitting 50, allowing more time for heat to pass from the water "W" to the inner wall 20.

Inlet fitting 40 and outlet fitting 50 may be positioned at any convenient location for access to the water jacket 12, to suit manufacturing and design preference.

The directional arrows 14 indicate the water flow path in the water jacket 12 between the inner wall 20 and the outer wall 30. The directional arrow 16 indicates the water flow path exiting from the shaving cream warming unit 10.

The water jacket 12 is formed by the inner wall 20, the outer wall 30 the lower end plate 32 and the upper end plate 34. The walls and end plates forming the water jacket 12 must be strong enough to safely withstand ordinary water line 8 pressures.

The inner wall 20 is preferably made of a heat conductive and corrosion-resistant metal, preferably brass, aluminum or stainless steel for improved heat conduction and corrosion resistance. The inner wall may also be made of a suitable plastic, or other commercially available materials. The canister "C" is heated by heat passing through the inner wall 20 into the space provided between the inner wall 20 and the shaving cream canister "C". Outer wall 30 and end plates 32, 34 are preferably made of insulating plastic, such as PVC, which reduces heat loss to the environment from the shower water. The water jacket formed by the inner wall 20, the outer wall 30 and end plates 32, 34 may be secured together by any known means, such as by gluing, ultrasonic welding, etc. An alternative construction is to make the entire unit 10 of brass, plastic or other suitable material. Heat lost into a shower stall is not wasted, as it contributes to warming the bather just as the shower water does.

Lower end plate 32 preferably is a flat plate that closes both the water jacket and the lower end of the warming chamber. It may be continuous except for one or more optional drain holes 36 (shown in FIG. 4) that allow water to drain from the warming chamber 11.

Upper end plate 34 includes a central aperture 38 to admit the can "C" into the warming chamber 11. The central aperture 38 is preferably sized to loosely receive a shaving cream canister "C" therethrough. The metal canister in which shaving cream and shaving gel are sold are almost universally of two sizes (not counting the upper caps and dispensing buttons): The larger size is about two and ⅝ inches in diameter by four and ½ inches high; and the smaller size is about two and ¼ inches in diameter and five and ½ or six and ½ inches high.

A resilient gasket or collar 42, is preferably made of a thermally-insulating material, such as neoprene foam, silicon rubber, or the like, and may be secured by any conventional means adjacent to the end plate 34. See FIG. 4. Alternately, resilient gasket 42 may be received in a slot or groove 44 as shown in FIG. 1.

The resilient gasket 42 has a central opening 46 which is smaller in diameter than the central aperture 38 in end plate 34, and is preferably sized to closely receive the outer diameter of a shaving cream canister "C" therein. The resilient material used in gasket 42 preferably is resilient enough to expand to engage the smaller can diameter of about two and ¼ inches, while constricting to also receive the larger canister size of about two and ⅝ inches in diameter. Alternately, the resilient gasket 42 may be selected to closely receive the larger canister "C" size, while leaving a small gap about the smaller shaving cream canister "C" size. This is less efficient, as some heat will escape through the gap between the smaller shaving cream canister "C" and the aperture 44 in the resilient gasket 42.

FIG. 2 is a cross sectional view of the warming unit 10 of FIG. 1, showing the preferred ribbed or finned structure 22, 24 of the inner wall 20. While the inner wall 20 is shown by a single line in the drawings, it should be understood that while the inner wall 20 is preferably thin, it is within the scope of this disclosure to make the inner wall of any thickness suitable to design or manufacturing preference. The ribbed or finned shape 22 extending within the water jacket 12 increases the surface area of the metal wall 20, improving heat transfer from the shower water "W" within the water jacket 12 to the inner wall 20. The ribs or fins 24 formed on the inner wall 20 preferably also extend within the warming chamber 11, thus also increasing the surface area in contact with the air within the warming chamber 11. This ribbed or finned shape 22, 24 also increases the strength the inner wall 20, which allows lighter gauge metal to be used for the inner wall 20, which both increases heat transfer, and reduces cost.

FIG. 3 is a cross section of the unit 10, similar to FIG. 2, but showing an alternate inner wall 20 fin or rib 22, 24 shape, with longitudinal ribs or fins 22, 24 projecting both inwardly and outwardly from a generally cylindrical wall 20.

In this embodiment, the inlet fitting 40 and the outlet fitting 40 are positioned in close juxtaposition and a baffle 60 is placed intermediate of the inlet fitting 40 and the outlet fitting 50. Baffle 60 extends from the inner wall 20 to the outer wall 30, and from end plate 32 to end plate 34, to direct the water to flow in a pattern encircling the warming chamber 11. The baffle 60 may be an extension of one of the outwardly projecting fins 22 extending within the water jacket 12.

The inlet fitting 40 and the outlet fitting may alternately be placed in other positions, for example, above or below the centerline, to suit manufacturing and design preference.

Figure 4:
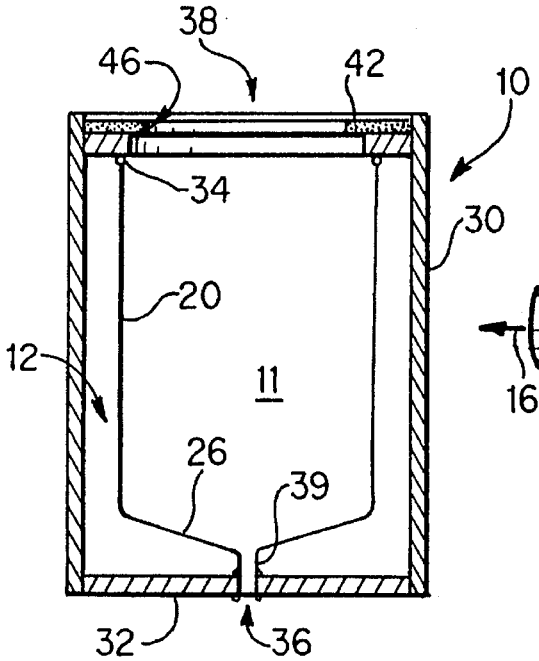
FIG. 4 is a vertical cross-sectional view of an alternative embodiment of the invention taken along lines 4—4 in FIG. 1.

FIG. 4 shows another embodiment of the shaving cream warming unit 10 in which the end plate 32 further includes one or more drain holes 36, allowing shower water which has collected in the warming chamber 11 to flow out through the drain hole(s) 36. The water jacket 12 may extend both between the inner wall 20 and the outer wall 30, as well as between the end plate 32 and an inner plate 26 extending in spaced relation above the end plate 32 across the bottom of the warming chamber 11. This embodiment allows the water "W" in the water jacket 12 greater surface area for heat transfer to the warming chamber 11. Inner plate 26 may be inclined as shown in FIG. 4, or may be substantially parallel to the lower end plate 32, to suit design and manufacturing preference. The inner wall and the inner plate may be formed of one peice, as shown in FIG. 4, subject to design and manufacturing preference.

Where the water jacket 12 extends below the warming chamber 11, as shown in FIG. 4, one or more tube(s) 39 may be provided to extend the drain hole(s) through the water jacket 12 between the inner plate 26 and the lower end plate 32.

Figure 5:
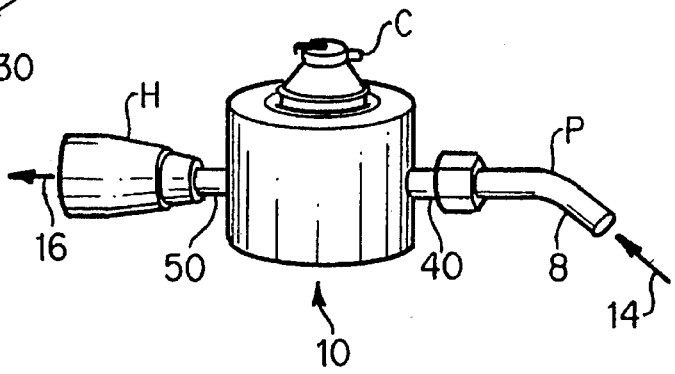
FIG. 5 is a perspective view of the invention mounted between the shower pipe and the shower head.

FIG. 5 shows the installation of the warming apparatus 10 between a typical water supply line 8 or pipe "P" and a shower head "H". A shaving cream canister "C" is shown inserted into the warming chamber 11 of the shaving cream warming unit 10.

Preferably, a resilient collar or gasket 42 closely receives the shaving cream can "C" to keep the hot air in the warming chamber 11 from quickly escaping through the central aperture 38.

Inlet fitting 40 is sized to be threadably connected to the water supply line 8 pipe "P". Outlet fitting 50 is sized to be threadably connected to the shower head "H". Threaded fittings typically used to connect a shower head "H" to a supply pipe "P" in the United States are typically a ½-inch IPS pipe thread. The threaded inlet fitting 40 is preferably made of brass, or other corrosion resistant material, and sized to threadably engage the threaded fitting on the water supply line 8 pipe "P". The threaded outlet fitting 50 is preferably of brass, or other corrosion resistant material, and sized to threadably engage the threaded fitting on the shower head "H". Inlet fitting 40 and outlet fitting 50 may be either male or female threads to suit local building codes, or to adapt to existing fittings.

An alternative placement of the warming apparatus 10, not pictured in FIG. 5, would be against the wall from which the pipe "P" normally protrudes. The bent pipe "P" is typically a proprietary item with male threads at both ends. It is usually screwed into a pipe "P" whose end is flush with the wall in the tub or the shower stall. In the alternative placement the outlet fitting 50 of the warming apparatus 10 could instead be screwed into the female fitting of the wall, the bent pipe P fastened to the inlet fitting 40, and the head "H" screwed directly to the pipe "P". This arrangement would reverse the flow of shower water through the warming apparatus 10, without affecting its function.

Where the warming apparatus 10 is intended for installation adjacent a wall, it may alternatively be designed to have a flat surface abutting the wall, to stabilize the warming apparatus 10 against the wall. The outline of the unit's outer wall 30 might in this case be D-shaped rather than O-shaped. The warming apparatus 10 in this alternative embodiment may include a wall mounting bracket 90 adapted for connection to a suitable support, such as a wall of the shower stall. (Not shown). Any conventional means of securement, such as screws, clips, brackets, adhesive, hook and loop type fastening means, etc. may be used to secure the bracket or the warming apparatus to the wall.

Figure 6:
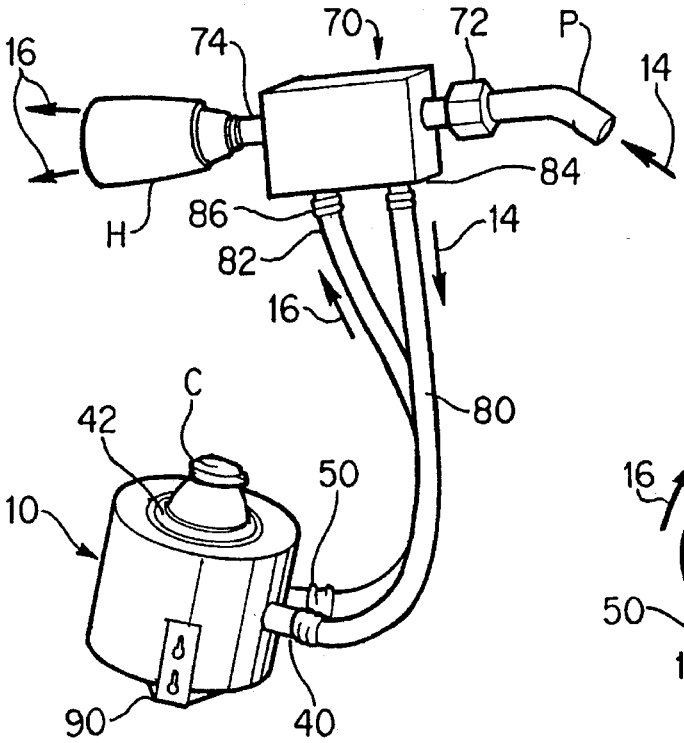
FIG. 6 is a perspective view of the invention for mounting below the shower head to a shower stall.

FIG. 6 depicts an alternative embodiment of the invention in which a diverter 70 allows the warming apparatus 10 to be installed in a position remote from the shower head "H". The diverter 70 includes inlet and outlet fittings 72, 74 which preferably have compatible threads for connection to the inlet water supply line 8 and to the shower head "H". The diverter 70 includes two internal connections: an inlet connector 76 to transfer fluid "W" from the water supply pipe "P" to a flexible inlet hose 80, and an outlet connector 78 to transfer water from a flexible outlet hose 82 to the shower head "H".

As shown in FIG. 6, the flexible inlet hose 80 is threadably secured to the inlet fitting 40, and the flexible outlet hose 82 is threadably secured to the outlet fitting 50. Thus, water "W" flows from the supply pipe "P" through the inlet connector 76, the flexible inlet hose 80, through the water jacket 12 to the flexible outlet hose 82, through the outlet connector 78, to the shower head "H", where it exits in a conventional manner.

The connections between the diverter 70 and the hoses 80, 82, and the hoses 80, 82 and the inlet and outlet fittings 40, 50, may be conventional pipe threads compatible with the connections at the shower head "H" and pipe "P". Alternately, the connections may be another type of known detachable connection, or may also be permanently attached, as by crimped connections, etc. without exceeding the scope of this disclosure, or the scope of the following claims.

The warming apparatus 10, when used with a diverter 70, may be permanently or releasably secured, by a suitable mounting means such as a base or a bracket 90, adapted to be secured to a wall, surface, or other fixture. The mounting bracket 90 or other mounting means may be of any conventional type known in the art.

Figure 7:
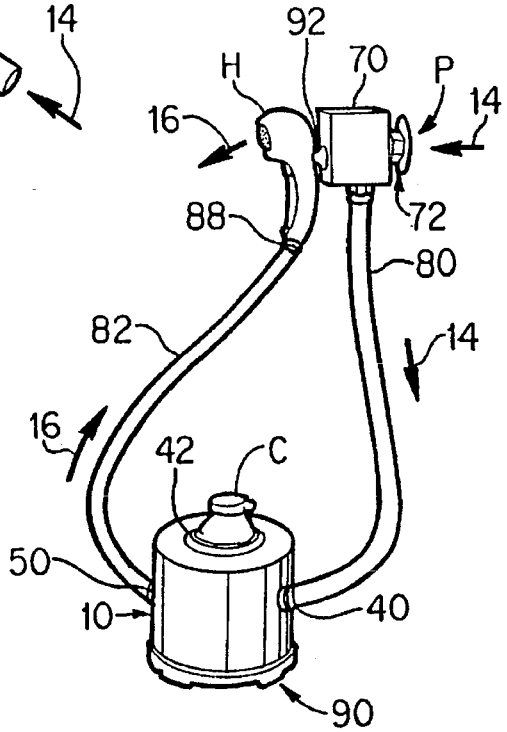
FIG. 7 is a perspective view of an alternate embodiment of the invention designed for use with a hand-held shower head.

An alternate embodiment of the invention, for use with a hand-held or massaging-type shower head 88, is shown in FIG. 7. The diverter 70 in this embodiment includes only one flexible inlet transfer hose 84, which connects at one end to the diverter 70, and at the other end to the inlet fitting 40 located on the warming apparatus 10. A flexible outlet hose 86 connects at one end to the outlet fitting 50 on the warming apparatus 10, and is threadably connected at the other end to the hand-held shower head 88. A suitable hook 92 may be included on the diverter 70 to hang the hand held shower head 88.

The present invention is intended primarily for use with showers. However, it may adapted for use with a bath, sink or faucet rather than a shower head, as will be apparent to those skilled in the plumbing arts. The scope of the following claims are intended to include such use, in accordance with the definition of a "water supply line".

A user can expect that a canister "C" of shaving cream or gel will be heated to a comfortable temperature, during the normal time used to shower. Thus, the canister will be ready when needed, without delay.

The present invention is perfectly safe, as it uses no electricity and its temperature regulation is assured by normal bathing procedures, which adjust the temperature of shower or bath water to comfortable levels.

The invention is energy-efficient because, in contrast to prior-art designs, the hot water used to shower, serves to also heat the shaving cream.

The canister warming chamber provides an ideal storage location for a shaving cream dispenser in the bath or shower, where it is ready for use when bathing or showering.

The invention is simple, uses well-known technology, is inexpensive, has no moving parts, and is easy to install and operate.

Thus, while the novel warming apparatus 10 has been fully disclosed and described herein, numerous modifications will become readily apparent to one of ordinary skill in this art, and such adaptations and modifications are intended to be included within the scope of the following claims.

I claim:

1. A shaving cream canister warming apparatus for fluid communication between a water supply line and a shower head, the shaving cream canister warming apparatus comprising:

an inner wall having an upper end and a lower end, the inner wall sized to receive a portion of the shaving cream canister therebetween;

an outer wall spaced about the inner wall, the outer wall having an upper end and a lower end;

an upper plate having a plate aperture sized to receive a portion of the shaving cream canister therethrough, the upper plate secured to the upper end of the inner wall and to the upper end of the outer wall;

a lower plate secured to the lower end of the inner wall and to the lower end of the outer wall, the lower plate extending substantially between the inner wall to support the shaving cream canister thereon; the inner wall, the upper plate and the lower plate forming a warming chamber therebetween;

the inner wall, the outer wall, the upper plate and the lower plate forming a water jacket surrounding the warming chamber, wherein a plurality of ribs extend from the inner wall into a portion of the water jacket to expand the surface contact between the inner wall and the fluid in the water jacket;

an inlet fitting extending from the water jacket for fluid communication with the water supply line;

an outlet fitting extending from the water jacket for fluid communication with the shower head; whereby the shaving cream canister having a shaving cream dispensing spout extends above the warming chamber for access to the shaving cream while the shaving cream canister is disposed within the warming chamber.

2. The warming apparatus of claim 1, wherein a resilient collar having a aperture sized to closely receive a portion of the canister therethrough, is secured to the upper plate in alignment with the aperture in the upper plate.

3. The warming apparatus of claim 1, further comprising:

a diverter having an inlet fitting for connection to the water supply line, the inlet fitting in fluid communication with a flexible inlet hose extending from the diverter to the inlet fitting of the warming apparatus; and a flexible outlet hose extending from the outlet fitting of the warming apparatus to the diverter, the outlet hose in fluid communication with an outlet fitting in the diverter, the outlet fitting in the diverter for connection to the shower head.

4. The warming apparatus of claim 3, wherein the warming apparatus is adapted for securement to a suitable support in proximity to the water supply line.

5. The warming apparatus of claim 1, wherein the inner wall comprises:

a thermally conductive, metal wall extending between the upper and lower end plates.

6. The warming apparatus of claim 1, wherein a plurality of ribs extend from the inner wall into the warming chamber, to expand the surface contact within the warming chamber.

7. The warming apparatus of claim 1, wherein the inlet fitting and the outlet fitting extending from the water jacket are spaced adjacent to each other, and a baffle extends within the water jacket between the inner wall, the outer wall, the lower end plate and the upper end plate; with the baffle positioned between the inlet fitting and the outlet fitting to extend the fluid path within the water jacket between the inlet and outlet fittings.

8. The warming apparatus of claim 3, wherein the shower head is a hand-held shower head connected to the outlet fitting of the warming apparatus with a flexible hose; and the inlet fitting of the warming apparatus is connected to a diverter with a flexible hose; and the diverter provides fluid communication between the flexible inlet hose and the fluid supply line.

9. The warming apparatus of claim 8, wherein a hook extends from the diverter, and a complimentary releasable connector extends from the hand held shower head for hanging the hand held shower head from the hook on the diverter.

10. The canister warming apparatus of claim 1, wherein at least one drain aperture is disposed beneath the warming chamber to drain fluid from the warming chamber.

11. A warming apparatus having a warming chamber for accepting a canister therein, the warming apparatus comprising:

an outer wall having an upper end and a lower end;

an inner wall disposed in spaced relation within the outer wall, the inner wall having an upper end and a lower end;

an upper end plate secured between the inner wall and the outer wall, the upper end plate having an upper plate aperture sized to receive a portion of the canister therethrough, the upper plate aperture positioned between the inner wall;

a lower end plate secured to the lower end of the outer wall and extending substantially between the outer wall;

an inner plate secured to the lower end of the inner wall in spaced relation above the lower end plate, the inner plate extending substantially between the inner wall;

a warming chamber formed between the inner wall, the aperture in the upper plate and the portion of the inner plate extending between the inner wall, the warming chamber sized to receive a portion of the canister therein;

a water jacket formed between the inner wall and the outer wall, and extending beneath the warming chamber between the inner plate and the lower end plate;

an inlet fitting for admitting water from a water supply line into the water jacket; and a water outlet fitting for expelling water from the water jacket; and a shower head connected in fluid communication to the water outlet fitting.

12. The warming apparatus of claim 1, wherein the inner wall includes projections extending partially within the water jacket, providing an increased surface area to promote rapid heat transfer from the fluid in the water jacket to the inner wall.

13. The warming apparatus of claim 11, wherein a resilient collar having a collar aperture sized to closely receive the canister therethrough, the resilient collar secured to the upper end plate, the collar aperture in alignment with the upper plate aperture.

14. The warming apparatus according to claim 11 wherein the inner wall includes projections extending partially within the warming chamber, providing an increased surface area to promote rapid heat transfer from the inner wall to the warming chamber.

15. The warming apparatus of claim 11, wherein the inner wall is made of a thermally conductive metal.

16. The warming apparatus of claim 11, wherein at least one drain aperture extends through the inner plate, through tubing extending between the inner plate and the lower end plate, and through the lower end plate, to isolate the drain aperture passing from the water jacket.

17. The warming apparatus of claim 11, further comprising:

a diverter having an inlet fitting for connection to the water supply line, the inlet fitting in fluid communication with a flexible inlet hose extending from the dfiverter to the inlet fitting of the warming apparatus; and a flexible outlet hose extending from the outlet fitting of the warming apparatus to the diverter, the outlet hose in fluid communication with an outlet fitting in the diverter, the outlet fitting in the diverter for connection to the shower head.

18. A canister warming apparatus for fluid connection between a water supply line and a shower head, the warning apparatus comprising:

an inner wall having an upper end and a lower end, the inner wall sized to receive the canister therebetween;

an outer wall spaced about the inner wall, the outer wall having an upper end and a lower end;

an upper plate having a plate aperture sized to receive the canister therethrough, the upper plate secured to the upper end of the inner wall and to the upper end of the outer wall;

a lower plate secured to the lower end of the inner wall and to athe lower end of the outer wall; the lower plate extending substantially between the inner wall to support the canister thereon;

a water jacket forming a fluid tight seal between the inner wall, the outer wall, the upper plate and the lower plate;

an inlet fitting extending from the water jacket;

an outlet fitting extending from the water jacket;

a warming chamber extending between the inner wall, the aperture in the upper plate, and the portion of the lower plate extending between the lower end of the inner wall; and a diverter having an inlet connector for connection to the water supply line, the inlet connector in fluid communication with a flexible inlet hose extending between the diverter and the inlet fitting on the water jacket, the diverter further having an outlet connector for connection to a shower head, with a flexible outlet hose extending between the diverter and the outlet fitting on the water jacket.

19. The warming apparatus of claim 17, wherein a resilient collar having an aperture sized to closely receive a portion of the conister therethrough is secured to to the upper plate in alignment with the aperture in the upper plate.

20. The warming apparatus of claim 17, wherein at least one drain aperture extends from the warming chamber to drain fluid from the warming chamber.

21. The warming apparatus of claim 17, wherein an inner plate is secured to the lower end of the inner plate and extends substantially between the inner wall, and the lower plate is secured to the lower end of the outer wall, in spaced relation to the inner plate, to extend the water jacket between the inner plate and the lower plate beneath the warming chamber.

22. The warming apparatus of claim 17, wherein the inner wall includes projections extending partially within the water jacket, providing an increased surface area to promote rapid heat transfer from the fluid in the water jacket to the inner wall, and wherein projections also extend from the inner wall, partially within the warming chamber, providing an increased surface area to promote rapid heat transfer from the inner wall to the warming chamber.

* * * * *